United States Patent [19]

Underwood

[11] 4,449,304

[45] May 22, 1984

[54] DRAWING INSTRUMENT AND LOCKING APPARATUS THEREFOR

[75] Inventor: Ronald E. Underwood, South Somerville, N.J.

[73] Assignee: Binney & Smith Inc., Easton, Pa.

[21] Appl. No.: 460,150

[22] Filed: Jan. 24, 1983

[51] Int. Cl.[3] ..... B43L 5/02; B43L 13/14

[52] U.S. Cl. ..... 33/437; 33/430; 33/433

[58] Field of Search ..... 33/437, 430, 1 K, 432, 33/433

[56] References Cited

U.S. PATENT DOCUMENTS

| | | | |
|---|---|---|---|
| 282,248 | 7/1883 | Weidenmann | 33/437 |
| 329,392 | 10/1885 | Jordan | 33/437 |
| 2,187,574 | 1/1940 | Nigra | 33/437 |
| 2,501,296 | 3/1950 | Tyler | 33/430 |
| 2,504,532 | 4/1950 | Kahan | 33/437 |
| 3,363,319 | 1/1968 | Greer | 33/437 |
| 3,537,183 | 11/1970 | Anderson | 33/437 |
| 3,786,568 | 1/1974 | Schultz et al. | 33/437 |

FOREIGN PATENT DOCUMENTS

| | | | |
|---|---|---|---|
| 15023 | of 1895 | United Kingdom | 33/433 |
| 671486 | 5/1952 | United Kingdom | 33/437 |

*Primary Examiner*—Willis Little

*Attorney, Agent, or Firm*—Charles A. Blank

[57] ABSTRACT

A drawing instrument and locking apparatus therefor in which the locking apparatus can be made of polyethylene, polypropylene or the like and is not subject to fragmentation or permanent damage during normal use. A displaceable member of the locking apparatus is displaceable into a groove of a drawing board to lock the drawing instrument in position thereon. An outer ring member freely rotatable through 360 degrees around the displaceable member when the displaceable member is in its raised condition engages the displaceable member when the displaceable member is in its depressed condition upon rotation of the ring member to unlock the apparatus.

12 Claims, 10 Drawing Figures

DRAWING INSTRUMENT AND LOCKING APPARATUS THEREFOR

This invention relates to drawing instruments and to locking appartus therefor, and, more particularly, to drawing instruments of the type usable on a flat surface having a groove therein cooperative with the locking apparatus.

One prior such drawing instrument is known in which the locking apparatus includes an elongated member having one or more protrusions on the bottom surface thereof for seating in the groove of the flat surface. A displaceable member is mounted on the elongated member and is displaceable into the groove in a depressed condition and has a wall cooperative with the protrusion to engage the groove to lock the instrument in position by a friction fit of the protrusion and the wall in the groove. An outer ring member is keyed to a support on the elongated member for rotation through a maximum angle less than forty-five degrees around the displaceable member.

The displaceable member has three projections and the elongated member has three ramps each with a forty-five degree ramp angle for engaging the three projections in certain keyed positions of the outer ring member around the displaceable member to raise the displaceable member from a depressed condition and overcome the friction fit of the locking apparatus. In other keyed positions of the outer ring member, the projections of the displaceable member do not engage the ramps and the displaceable member can be manually depressed to lock the drawing instrument in position.

This prior drawing instrument requires the use of costly plastic materials for the locking apparatus, for example, polycarbonate, acrylonitrile-butadiene rubber or material with similar properties to provide structural strength and rigidity in order to function properly. A high degree of molding technology and expertise is required due to critical molding factors involved. A slow rate of manufacturing is necessary due to preconditioning of material, for example, in drying stages, and to the monitoring and adherence to the molding factors involved.

Another such prior drawing instrument has been made having locking apparatus using less costly material, for exampe, polyethylene, polypropylene or the like. I have discovered that through normal use, this prior apparatus has a tendency to bind internally and that to overcome this binding, sufficient turning force is exerted on the outer ring by the user to shear the keyway of the outer ring, causing permanent damage. There is also the danger of potential fragmentation which might injure the user, who would ordinarily be a child.

It is an object of the present invention, therefore, to provide a new and improved drawing instrument and locking apparatus therefor which avoids one or more of the disadvantages of prior such instruments and apparatus.

It is another object of the invention to provide a new and improved drawing instrument and locking apparatus therefor which is not subject to fragmentation or permanent damage during normal use.

It is another object of the invention to provide a new and improved drawing instrument and locking apparatus therefor which requires less strength and rigidity, enabling the use of less costly materials and less critical molding factors than prior such instruments and apparatus.

In accordance with the invention, a drawing instrument displaceable on a flat surface having a groove therein comprises an elongated member having a straight edge and having at least one protrusion on the bottom surface thereof for seating in the groove of the flat surface. The drawing instrument also includes a displaceable member mounted on the elongated member and displaceable into the groove in a depressed condition and out of the groove in a raised condition and in the depressed condition having a wall cooperative with the protrusion to engage the groove to lock the instrument in position by a friction fit of the protrusion and the wall in the groove. The drawing instrument also includes an outer ring member rotatably mounted on the elongated member and freely rotatable through 360 degrees around the displaceable member when the displaceable member is in the raised condition and including means for engaging the displaceable member when the displaceable member is in the depressed condition upon rotation of the ring member to raise the displaceable member by applying thereto a force overcoming the aforesaid friction fit. The drawing instrument also includes spring means for maintaining the displaceable member in the raised condition until the displaceable member is depressed.

Also in according with the invention, in a drawing instrument displaceable on a flat surface having a groove therein, apparatus for locking the instrument in a selected fixed position along the flat surface comprises at least one protrusion on the drawing instrument for seating in the groove of the flat surface. The locking apparatus also includes a displaceable member which is displaceable into the groove in a depressed condition and out of the groove in a raised condition and in the depressed condition having a wall cooperative with the protrusion to engage the groove to lock the instrument in position by a friction fit of the protrusion and the wall in the groove. The locking apparatus also includes an outer ring member freely rotatable through 360 degrees around the displaceable member when the displaceable member is in the raised condition and including means for engaging the displaceable member when the displaceable member is in the depressed condition upon rotation of the ring member to raise the displaceable member by applying thereto a force overcoming the aforesaid friction fit. The locking apparatus also includes spring means for maintaining the displaceable member in the raised condition until the displaceable member is depressed.

For a better understanding of the present invention, together with other and further objects thereof, reference is made to the following description, taken in connection with the accompanying drawings, and its scope will be pointed out in the appended claims.

Referring now to the drawings:

FIG. 6 is a fragmentary, sectional view of the FIG. 2 drawing instrument, taken along line 6—6 of FIG. 2, locked into the groove of the drawing board;

Figure 1:
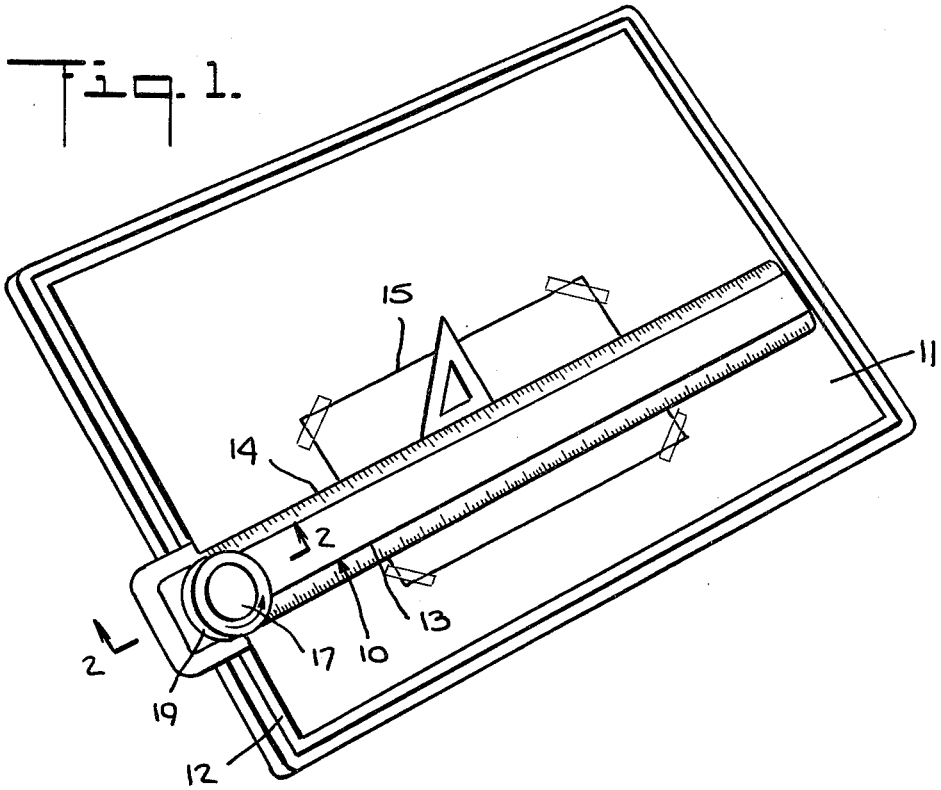
FIG. 1 is a perspective view of a flat drawing board having a groove therein and having a drawing instrument constructed in accordance with the invention displaceable thereon.

Referring now more particularly to FIG. 1 of the drawings, there is represented a drawing instrument 10 displaceable on a flat surface 11 of a drawing board having a groove 12 therein. The drawing instrument comprises an elongated member 13 having a straight edge 14 for use, for example, in guiding a drawing triangle and a pencil to draw lines on a paper 15 attached to the flat surface 11.

Figure 2:
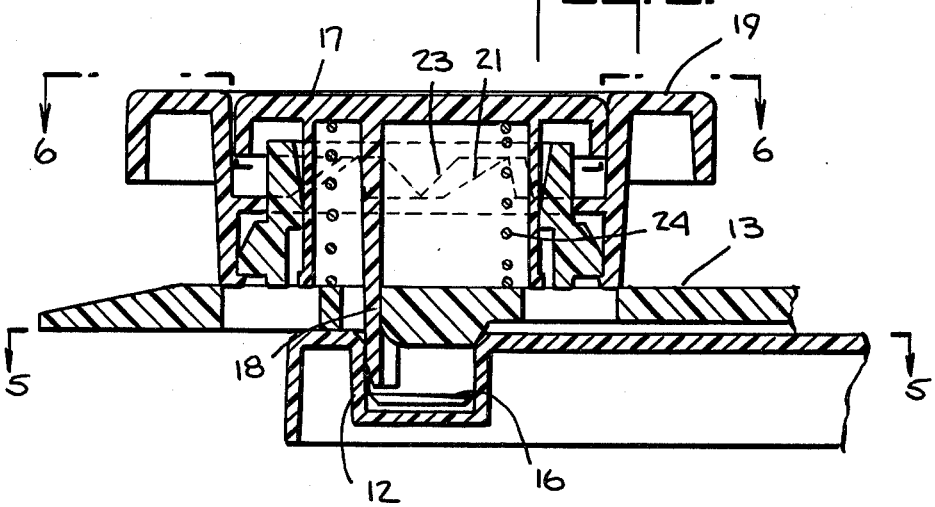
FIG. 2 is a fragmentary sectional view, to an enlarged scale, of the FIG. 1 drawing instrument locked in position on the FIG. 1 drawing board.
Figure 3:
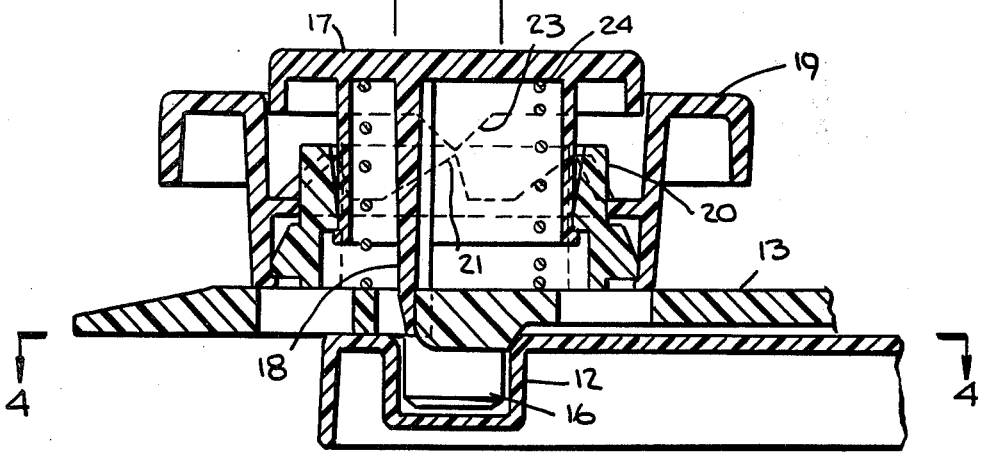
FIG. 3 is a fragmentary sectional view, to an enlarged scale, of the FIG. 1 drawing instrument corresponding to FIG. 2 but with the drawing instrument unlocked from the FIG. 1 drawing board.

Referring now to FIGS. 1, 2 and 6, the elongated member 13 has at least one protrusion 16 on the bottom surface thereof for seating in the groove 12 of the flat surface 11. The drawing instrument includes a displaceable member 17 mounted on the elongated member 13 and displaceable into the groove 12 in a depressed condition. As represented in FIG. 3, the displaceable member 17 is displaceable out of the groove 12 in a raised condition. In the depressed condition the displaceable member 17 has a wall 18 cooperative with the protrusions 16 to engage the groove 12 to lock the drawing instrument 10 in position by a friction fit of the protrusions 16 and the wall 18 in the groove, as represented in FIGS. 2 and 6.

Figure 8:
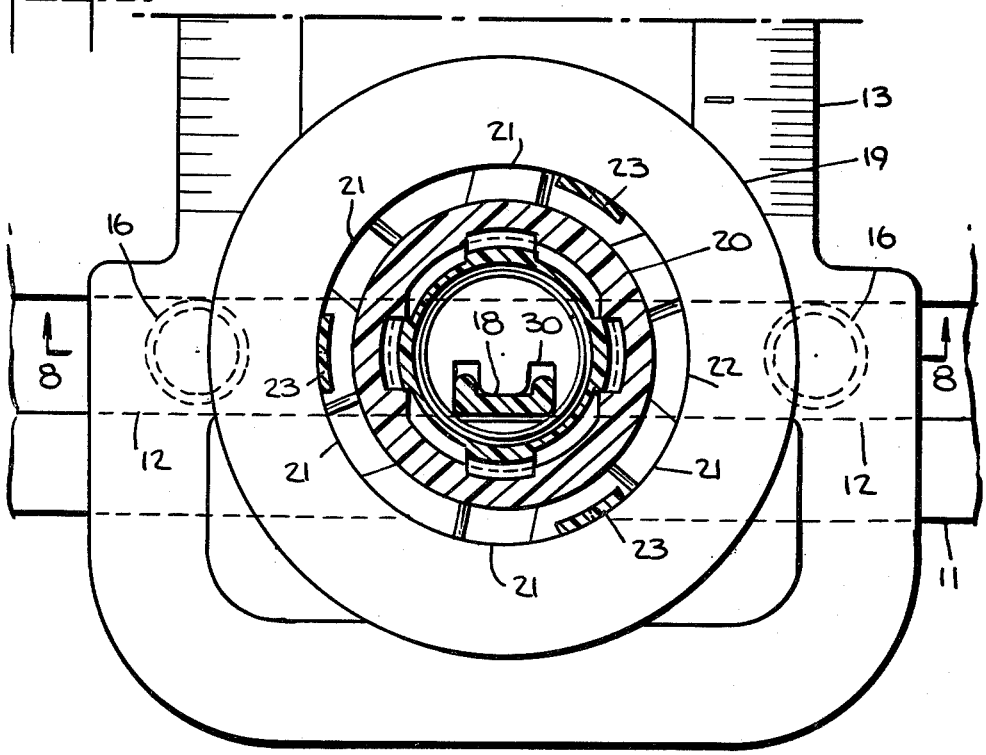
FIG. 8 is a fragmentary, sectional view of the FIG. 2 drawing instrument, taken along line 8—8 of FIG. 6, locked into the groove of the drawing board.
Figure 8:
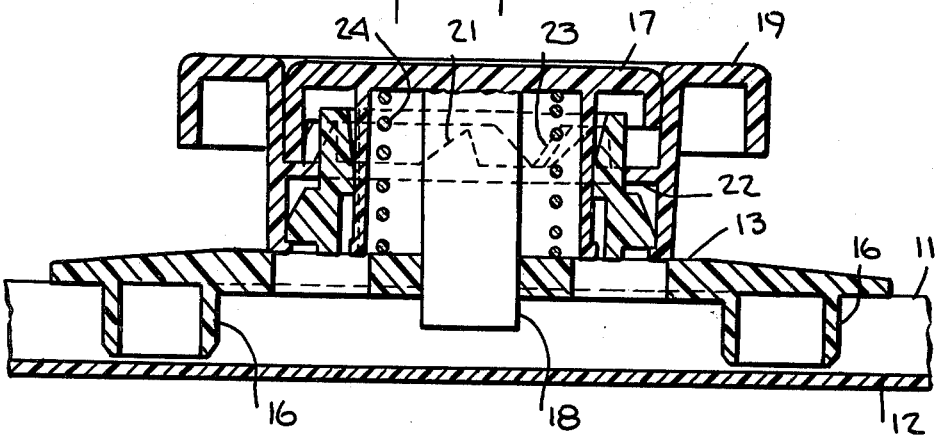
Figure 9:
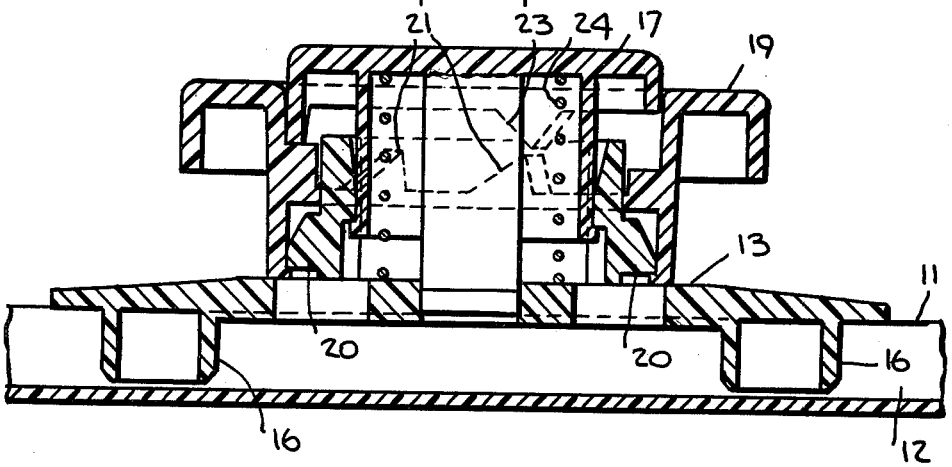
FIG. 9 is a fragmentary, sectional view of the drawing instrument as represented in FIG. 8 but with the drawing instrument unlocked from the drawing board.

Referring now to FIGS. 1, 2, 6, 8, 9 and 10, the drawing instrument 10 includes an outer ring member 19 rotatably mounted on the elongated member 13 and freely rotatable through 360 degrees around the displaceable member 17 when the displaceable member 17 is in its raised condition, as represented in FIG. 9. To this end, an upstanding ring portion 20 integral with the elongated member 13 and about which the outer ring member 19 rotates is provided.

Figure 7:
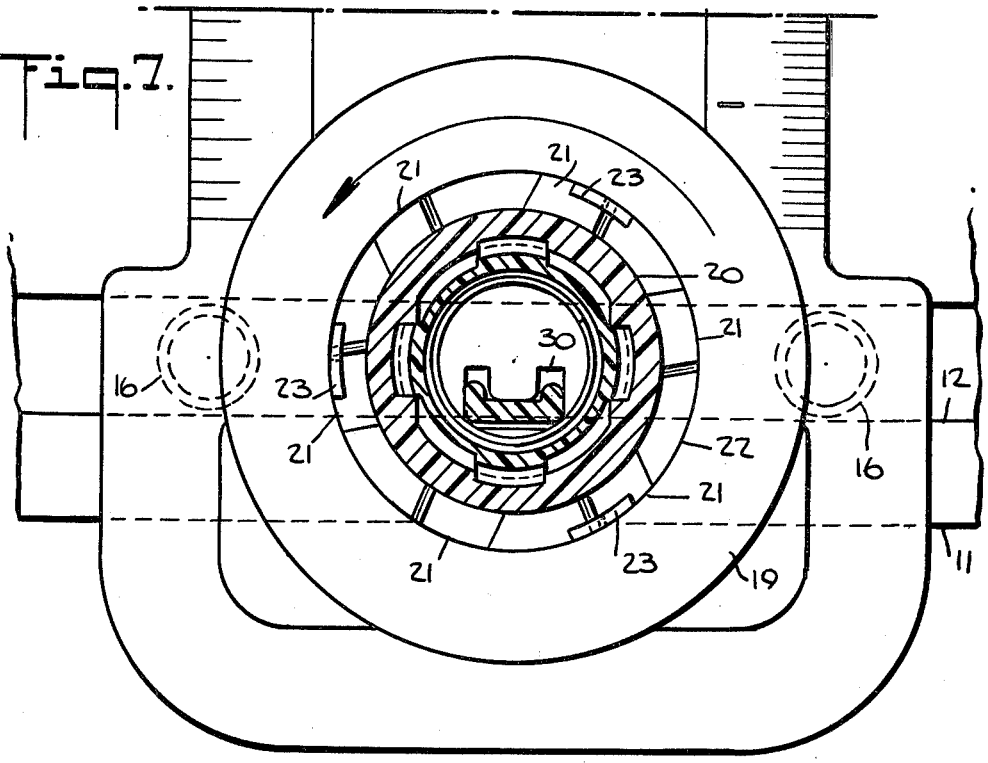
FIG. 7 is a fragmentary, sectional view of the drawing instrument as represented in FIG. 6 but with the drawing instrument unlocked from the groove of the drawing board.
Figure 10:
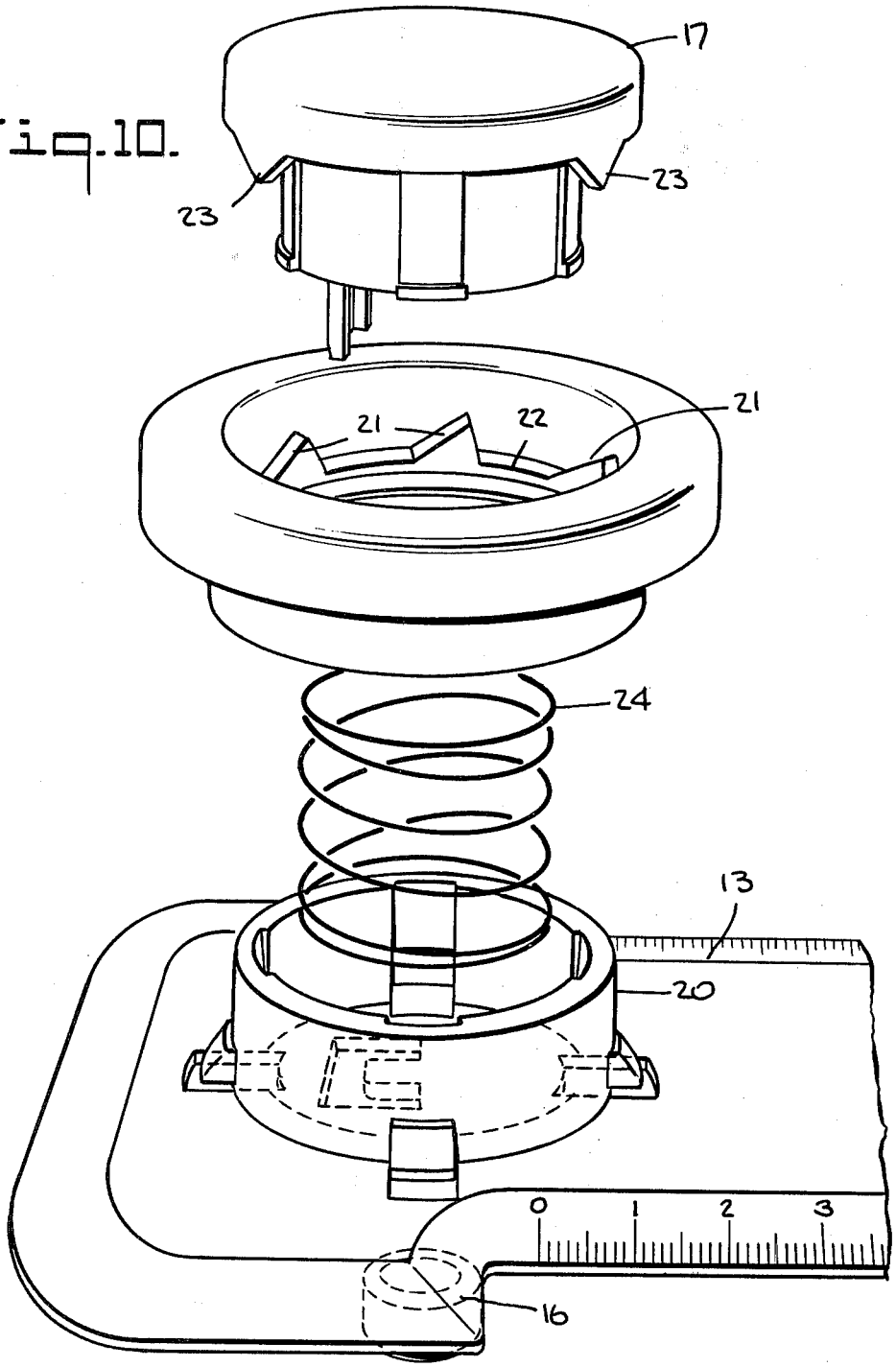
FIG. 10 is a fragmentary, exploded perspective view, to an enlarged scale, of the FIG. 1 drawing instrument.

Referring now to FIGS. 8, 9 and 10, the outer ring member 19 includes means for engaging the displaceable member when the displaceable member 17 is in its depressed condition upon rotation of the ring member 19 to raise the displaceable member 17 by applying thereto a force overcoming the friction fit of the wall 18 in the groove 12. More particularly, the engaging means of the outer ring member includes discrete ramps 21 on an inner shelf 22 of the outer ring member 19, as may also be seen in FIGS. 6 and 7. There preferably are six ramps 21 uniformly spaced around the outer ring member 19, each with a preferred ramp angle of inclination of approximately thirty degrees.

Referring now to FIGS. 2, 3, 6, 7, 8, 9 and 10, the displaceable member 17 includes discrete projections 23 and the discrete ramps 22 of the outer ring member 17 abut the projections 23 of the displaceable member 17 when the displaceable member is in its depressed condition, upon rotation of the ring member 19. There preferably are three projections 23 uniformly spaced around the displaceable member 17. The outer ring member 19 preferably includes a number of the ramps 21 which is greater than the number of the projections included in the displaceable member 17.

Referring now to FIGS. 2, 3, 8, 9 and 10, the drawing instrument also includes spring means, preferably comprising a coil spring 24, for maintaining the displaceable member 17 in its raised condition, until the displaceable member 17 is depressed.

Figure 4:
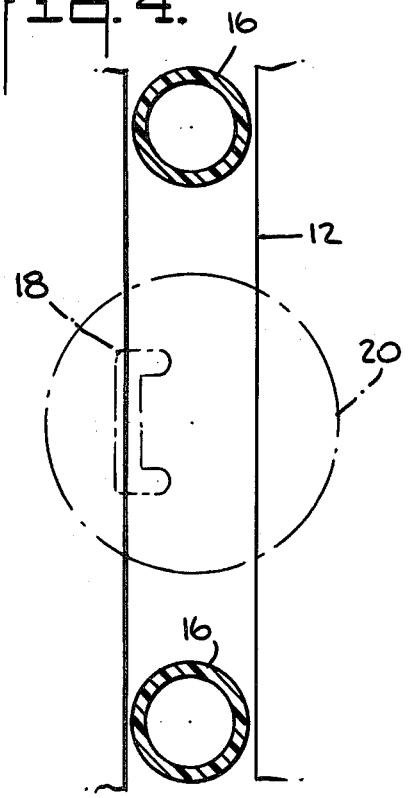
FIG. 4 is a fragmentary view of the drawing board and a fragmentary, sectional view of the drawing instrument, taken along line 4—4 of FIG. 3.

Considering now the operation of the drawing instrument 10, the drawing instrument 10 may be moved to a selected position as represented in FIG. 1 with the protrusions 16 in the groove 12 and the displaceable member 17 in its raised condition as represented in FIGS. 3 and 9. The wall 18 is then outside the groove 12 and the protrusions are freely slidable in the groove 12 as represented in FIG. 4.

The outer ring 19 is freely rotatable through 360 degrees around the displaceable member 17 because the spring 24 acting against the member 13 raises the displaceable member 17 sufficiently that the projections 23 thereof are above the ramps 21 of the outer ring 19.

Figure 5:
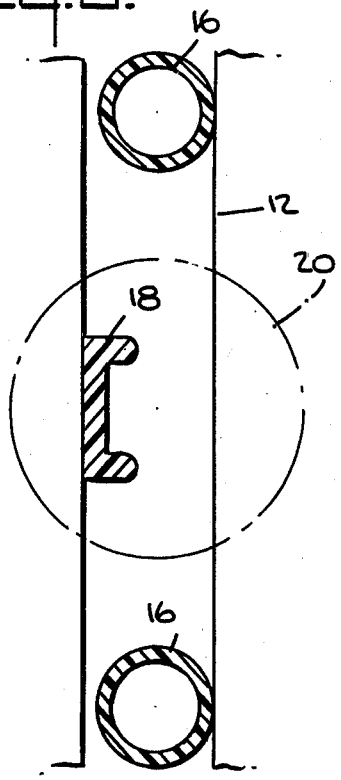
FIG. 5 is a fragmentary view of the drawing board and a fragmentary, sectional view of the drawing instrument, taken along line 5—5 of FIG. 2.

To lock the drawing instrument 10 in the selected position, the displaceable member 17 may be manually depressed as represented in FIGS. 2 and 8. The wall 18 is then inserted into the groove 12 as represented in FIGS. 2 and 8. As represented in FIG. 6, the wall 18 passes through a slot 30 in the elongated member 13. The wall 18 then cooperates with the protrusions 16 to engage the groove 12 to lock the drawing instrument in position by a friction fit of the protrusions 16 and the wall 18 in the groove 12 as represented in FIG. 5.

To unlock the drawing instrument 10 from the flat surface 11, the outer ring 19 may be rotated in the direction of the arrow of FIG. 7 from the locked position represented in FIGS. 2, 6 and 8 with the projections 23 of the displaceable member 17 displaced from the ramps 21 of the outer ring 19 to the unlocked position represented in FIGS. 3, 7 and 9. During this rotation, the projections 23 are contacted by the ramps 21 and the ramps 21 gradually and smoothly lift the projections 23 until the wall 18 of the displaceable member 17 is lifted out of the groove 12. The spring 24 continues to lift the displaceable member 17 so that the projections 23 are slightly above the ramps 21.

Ordinarily when the outer ring 19 is rotated to unlock the drawing instrument, the final position of the ring 19 will be determined at random and the projections 23 of the displaceable member will not be positioned with their peaks directly above the peaks of the ramps 21 of the outer ring 19. To lock the drawing instrument again, the ring 17 may be manually depressed and even if the peaks of the projections 23 are directly above the peaks of the ramps 21, a slight rotation of the ring 19 will enable the user to depress the displaceable member to the locked, fully depressed condition.

From the foregoing description, it will be apparent that since the outer ring 19 is freely rotatable through 360 degrees until the displaceable member 17 is depressed, binding and shearing of the locking apparatus are eliminated. Also, since the ramps 21 are at an incline of thirty degrees, the unlocking of the apparatus is accomplished easily and smoothly. The provision of six ramps 21 with three projections 23 results in unlocking or releasing the locking apparatus upon rotation of the outer ring 19 through a maximum angle of sixty degrees.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A drawing instrument displaceable on a flat surface having a groove therein comprising:

an elongated member having a straight edge and having at least one protrusion on the bottom surface thereof for seating in the groove of the flat surface;

a displaceable member mounted on said elongated member and displaceable into the groove in a depressed condition and out of the groove in a raised condition and in said depressed condition having a wall cooperative with said protrusion to engage the groove to lock the instrument in position by a friction fit of said protrusion and said wall in the groove, an outer ring member rotatably mounted on said elongated member and freely rotatable through 360 degrees around said displaceable member when said displaceable member is in said raised condition and including means for engaging said displaceable member when said displaceable member is in said depressed condition upon rotation of said ring member to raise said displaceable member by applying thereto a force overcoming said friction fit;

and spring means for maintaining said displaceable member in said raised condition until said displaceable member is depressed.

2. A drawing instrument in accordance with claim 1 in which said means included in said outer ring member for engaging said displaceable member includes discrete ramps for abutting said displaceable member when said displaceable member is in said depressed condition upon rotation of said ring member.

3. A drawing instrument in accordance with claim 2 in which said displaceable member includes discrete projections and in which said discrete ramps of said outer ring member abut said projections of said displaceable member when sid displaceable member is in said depressed condition upon rotation of said ring member.

4. A drawing instrument in accordance with claim 3 in which said outer ring member includes a number of said ramps greater than the number of said projections included in said displaceable member.

5. A drawing instrument in accordance with claim 4 in which said outer ring member includes six ramps uniformly spaced around said outer ring member and in which said displaceable member includes three projections uniformly spaced around said displaceable member.

6. A drawing instrument in accordance with claim 2 in which said ramps each have a ramp angle of approximately thirty degrees.

7. In a drawing instrument displaceable on a flat surface having a groove therein, apparatus for locking the instrument in a selected fixed position along the flat surface comprising:

at least one protrusion on the drawing instrument for seating in the groove of the flat surface;

a displaceable member which is displaceable into the groove in a depressed condition and out of the groove in a raised condition and in said depressed condition having a wall cooperative with said protrusion to engage the groove to lock the instrument in position by a friction fit of said protrusion and said wall in the groove;

an outer ring member freely rotatable through 360 degrees around said displaceable member when said displaceable member is in said raised condition and including means for engaging said displaceable member when said displaceable member is in said depressed condition upon rotation of said ring member to raise said displaceable member by applying thereto a force overcoming said friction fit;

and spring means for maintaining said displaceable member in said raised condition until said displaceable member is depressed.

8. A locking apparatus in accordance with claim 7 in which said means included in said outer ring member for engaging said displaceable member includes discrete ramps for abutting said displaceable member when said displaceable member is in said depressed condition upon rotation of said ring member.

9. A locking apparatus in accordance with claim 8 in which said displaceable member includes discrete projections and in which said discrete ramps of said outer ring member abut said projections of said displaceable member when said displaceable member is in said depressed condition upon rotation of said ring member.

10. A locking apparatus in accordance with claim 9 in which said outer ring member includes a number of said ramps greater than the number of said projections included in said displaceable member.

11. A drawing instrument in accordance with claim 10 in which said outer ring member includes six ramps uniformly spaced around said outer ring member and in which said displaceable member includes three projections uniformly spaced around said displaceable member.

12. A drawing instrument in accordance with claim 8 in which said ramps each have a ramp angle of approximately thirty degrees.

* * * * *